US006640466B1

(12) United States Patent
Liu

(10) Patent No.: US 6,640,466 B1
(45) Date of Patent: Nov. 4, 2003

(54) EASY-TO-WEAR FOOTWEAR

(76) Inventor: Kun-Chung Liu, No. 5, Alley 9, Lane 212, San-Feng Rd., Hou-Li Hsiang, Taichung Hsien (TW)

( * ) Notice: Subject to any disclaimer, the term of this patent is extended or adjusted under 35 U.S.C. 154(b) by 8 days.

(21) Appl. No.: 10/137,902

(22) Filed: May 2, 2002

(51) Int. Cl.[7] ..... A61F 5/37
(52) U.S. Cl. ..... 36/50.1
(58) Field of Search ..... 36/50.1, 50.5, 36/138; 24/712, 712.1–712.9, 713.1–713.9

(56) References Cited

U.S. PATENT DOCUMENTS

| | | | | |
|---|---|---|---|---|
| 4,414,761 A | | 11/1983 | Mahood | |
| 5,353,483 A | * | 10/1994 | Louviere | 24/12.1 |
| 5,469,640 A | | 11/1995 | Nichols | |
| 5,926,976 A | * | 7/1999 | Cretinon et al. | 36/50.1 |
| 6,347,436 B1 | * | 2/2002 | Barber et al. | 24/68 SK |
| 6,568,104 B2 | * | 5/2003 | Liu | 36/50.1 |

FOREIGN PATENT DOCUMENTS

CH 674445 * 6/1990

OTHER PUBLICATIONS

U.S. patent application Ser. No. 09/941,346 filed Aug. 28, 2001 ( Ref. not enclosed).

* cited by examiner

*Primary Examiner*—Ted Kavanaugh
(74) *Attorney, Agent, or Firm*—Knobbe, Martens, Olson & Bear, LLP

(57) ABSTRACT

An anchoring assembly on a footwear body includes a stationary member, a pivotable member, a pivot unit and a releasable fastener unit. The stationary member is fixed on the footwear body. The pivotable member is provided with a footwear lace stringing part that is formed with at least one eyelet. The pivot unit is provided on the stationary and pivotable members to permit pivoting movement of the pivotable member relative to the stationary member about a pivot axis between a footwear tightening position and a footwear loosening position. The releasable fastener unit is provided on the stationary and pivotable members and releasably retains the pivotable member at the footwear tightening position.

9 Claims, 13 Drawing Sheets

EASY-TO-WEAR FOOTWEAR

BACKGROUND OF THE INVENTION

1. Field of the Invention

The invention relates to a footwear, more particularly to a footwear w which is easy to wear and remove.

2. Description of the Related Art

A conventional footwear usually includes a footwear body with a top opening, and a footwear lace. The footwear body includes a vamp, a tongue, and a pair of eyelet tabs. The tongue has a front portion connected to the vamp, and a rear portion extending to the top opening. The tongue further has an opposite pair of lateral sides that extend from the vamp to the top opening. Each of the eyelet tabs is connected to the vamp, and is disposed adjacent to one of the lateral sides of the tongue. Each of the eyelet tabs is formed with a plurality of eyelets that are aligned with each other in a direction from the vamp to the top opening. The footwear lace has a front portion, and a rear portion. The front portion of the footwear lace is strung through the eyelets to form a criss-cross pattern on the eyelet tabs. The rear portion of the footwear lace can be tied together so as to tighten the footwear. However, it is time-wasting to tie and untie the footwear lace when wearing and removing the footwear.

U.S. Pat. No. 5,469,640 discloses a quick adjusting footwear lace system for adjusting footwear lace tension in a single movement. Referring to FIGS. 1 and 2, the footwear lace system disclosed in this U.S. patent includes a cinch plate 3 having eyelets 301 which are spaced apart by about the same distance as eyelets 201 formed in the eyelet tabs of the footwear. The footwear lace 1 is strung through the eyelets 301 at the cinch plate 3 along with the eyelets 201 in the eyelet tabs of the footwear. A strap 4, fixably attached at a lower end to the footwear body 2 and loopable at an upper end through a slot in the cinch plate 3, is used to adjustably pull the cinch plate 3 and the footwear lace 1 looped through the eyelets 301 downwardly and thus increase the footwear lace tension so as to tighten the footwear. However, the footwear lace system disclosed in this U.S. patent is merely configured to adjust tension of the footwear lace, and does not facilitate wearing and removal of the footwear.

U.S. Pat. No. 4,414,761 discloses a footwear having an improved closure. Referring to FIGS. 3 and 4, the closure of the footwear 6 disclosed in this U.S. patent includes a first elongate area 601 provided with a plurality of eyelets, a second non-apertured elongate area 602 provided with a male VELCRO™ fastener 702, a footwear lace 5, and a panel 7 provided with a plurality of eyelets corresponding to the eyelets of the first elongate area 601 and a female VELCRO™ fastener 701 on the inner surface of the panel 7. The footwear lace 5 is strung through the eyelets of the first elongate area 601 and the eyelets of the panel 7 to form a criss-cross pattern. The panel 7 can releasably engage the second non-apertured elongate area 602 through the engagement between the male and female fasteners 702, 701.

Although the footwear disclosed in U.S. Pat. No. 4,414,761 facilitates wearing and removal of the footwear, the VELCRO™ fasteners are liable to loosen during use and easily accumulate dirt thereon.

SUMMARY OF THE INVENTION

Therefore, the object of the present invention is to provide a footwear which is easy to wear and remove and which has fasteners that can prevent undesired loosening.

The footwear according to this invention includes a footwear body, an anchoring assembly, and a footwear lace unit.

The footwear body has a top opening, and includes a vamp, a tongue, a first eyelet tab and a second eyelet tab. The tongue has a front portion connected to the vamp, and a rear portion extending in a longitudinal direction to the top opening. The tongue further has an opposite pair of lateral sides that are spaced apart from each other in a transverse direction transverse to the longitudinal direction and that extend from the vamp to the top opening. The first and second eyelet tabs are connected to the vamp and are respectively disposed adjacent to the lateral sides of the tongue. The first eyelet tab is formed with a plurality of eyelets. The second eyelet tab includes a front portion proximate to the vamp, a rear portion proximate to the top opening, and an intermediate eyelet-free portion between the front and rear portions of the second eyelet tab. Each of the front and rear portions of the second eyelet tab is provided with at least one eyelet.

The anchoring assembly includes a stationary member, a pivotable member, a pivot unit and a releasable fastener unit. The stationary member is fixed on the eyelet-free portion of the second eyelet tab. The pivotable member is provided with a footwear lace stringing part that is formed with at least one eyelet. The pivot unit is provided on the stationary and pivotable members proximate to the tongue of the footwear body to permit pivoting movement of the pivotable member relative to the stationary member about a pivot axis that extends in the longitudinal direction between a footwear tightening position, in which the pivotable member is turned toward the stationary member so as to be superimposed on the stationary member, and a footwear loosening position, in which the pivotable member is turned away from the stationary member. The releasable fastener unit is provided on the stationary and pivotable members, and releasably retains the pivotable member at the footwear tightening position.

The footwear lace unit has a first portion and a second portion. The first portion of the footwear lace unit is strung through the eyelets of the first eyelet tab, the eyelets of the second eyelet tab and at least one eyelet of the footwear lace stringing part of the pivotable member to form a criss-cross pattern on the first and second eyelet tabs. The second portion of the footwear lace unit is disposed proximate to the top opening.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
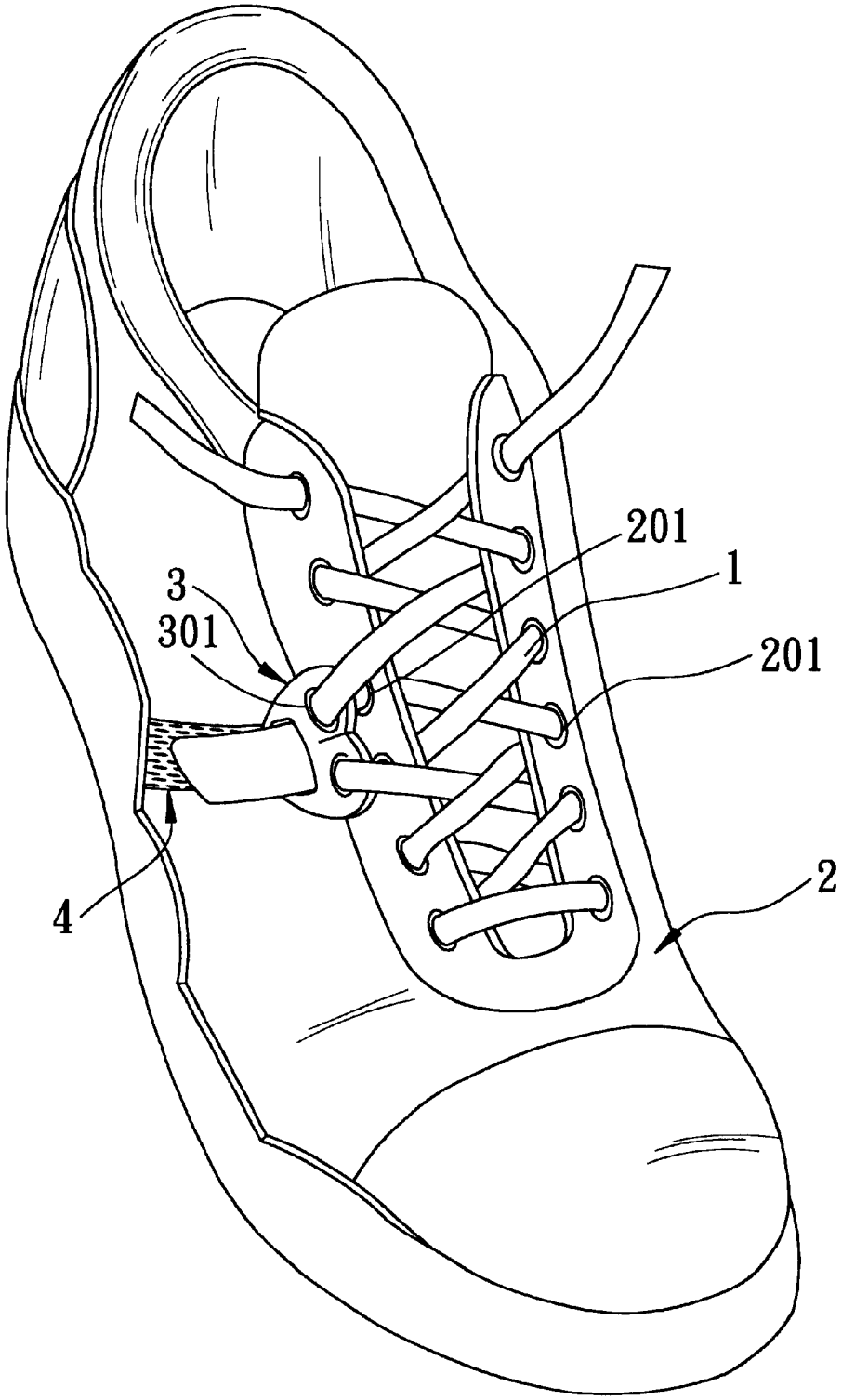
FIG. 1 PRIOR ART
FIG. 1 is a perspective view of a conventional footwear disclosed in U.S. Pat. No. 5,469,640.
Figure 2:
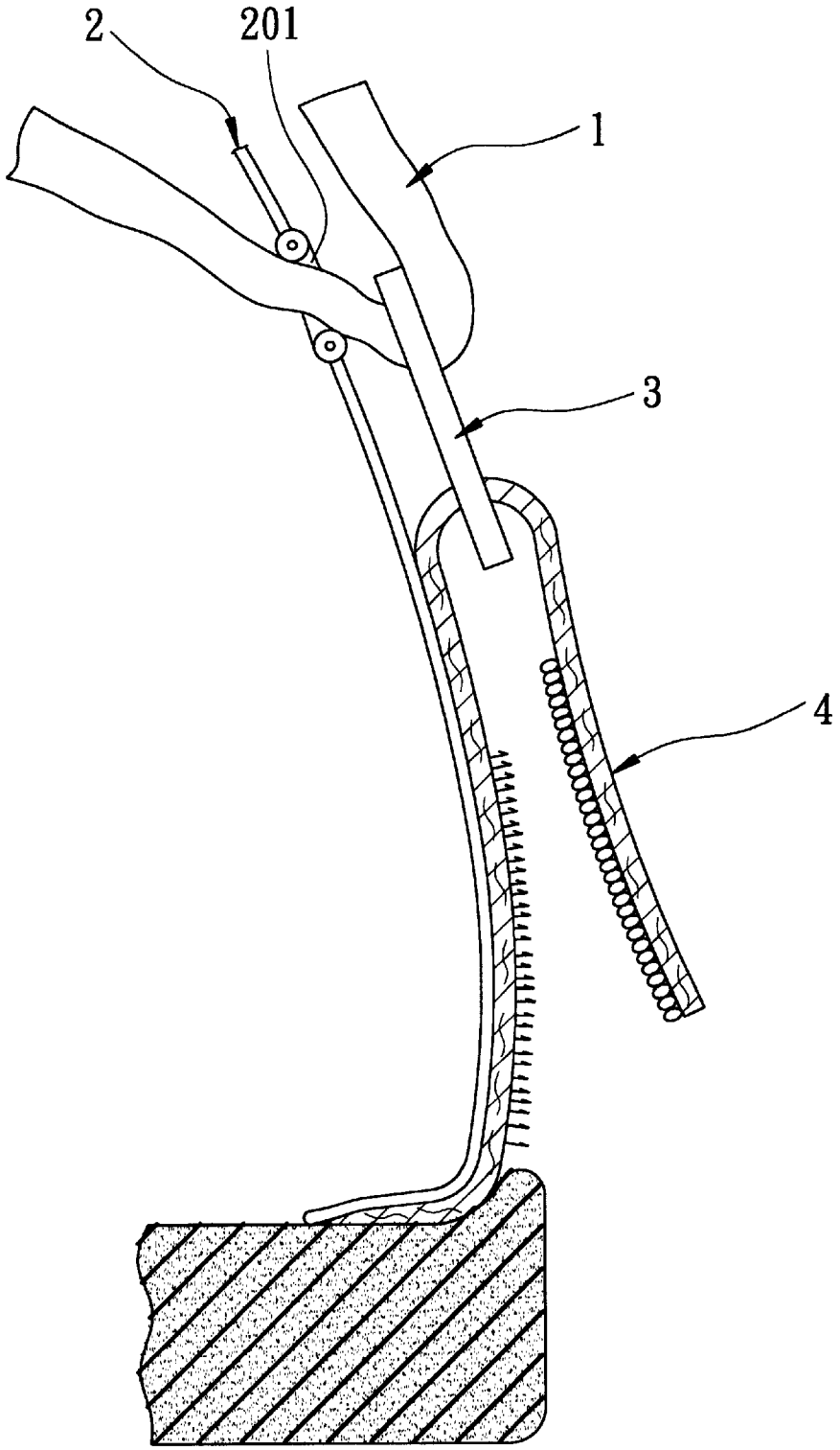
FIG. 2 PRIOR ART
FIG. 2 is a fragmentary sectional view of the footwear of FIG. 1.
Figure 3:
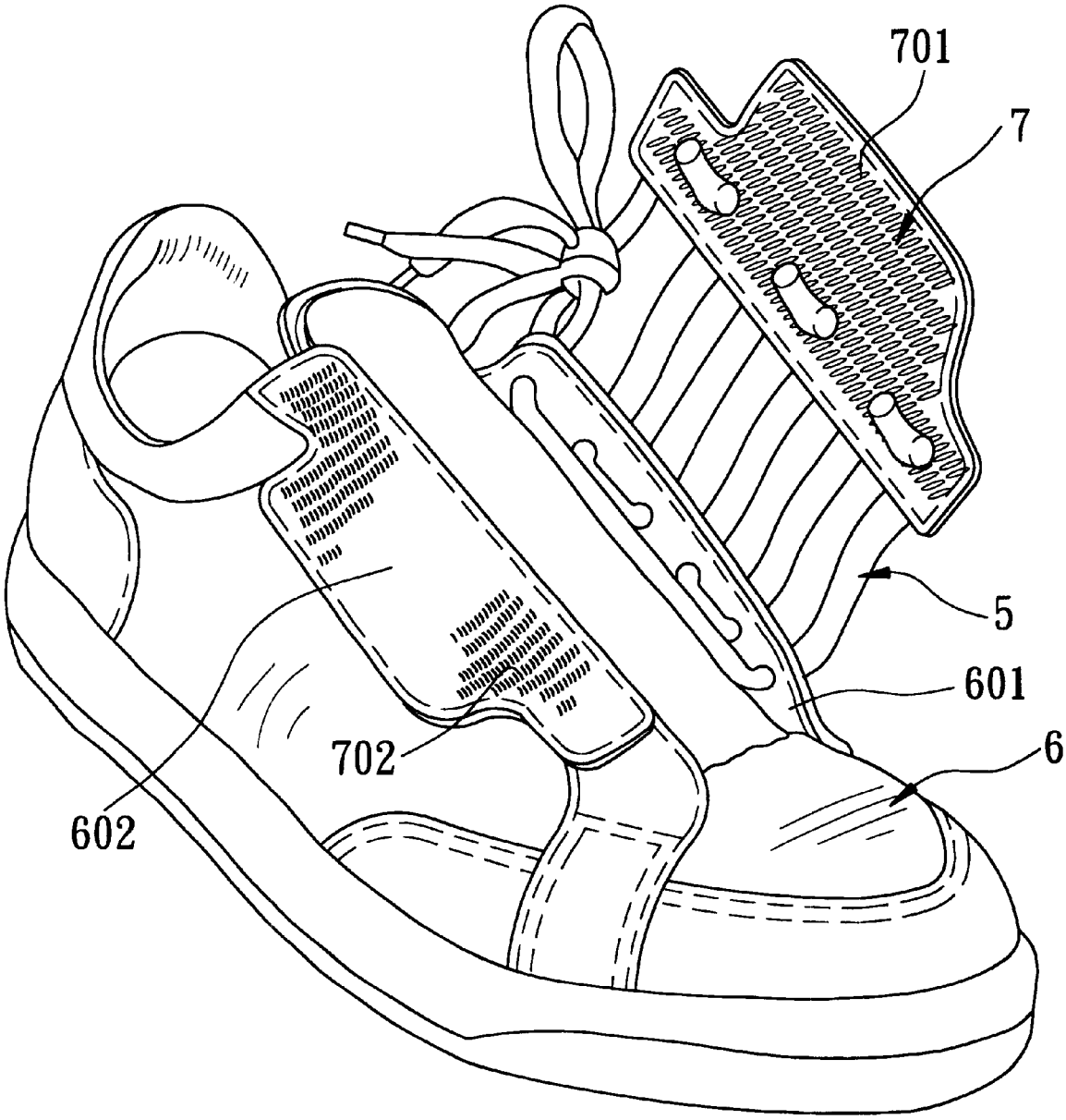
FIG. 3 PRIOR ART
FIG. 3 is a perspective view of another conventional footwear disclosed in U.S. Pat. No. 4,414,761 in an opened state.
Figure 4:
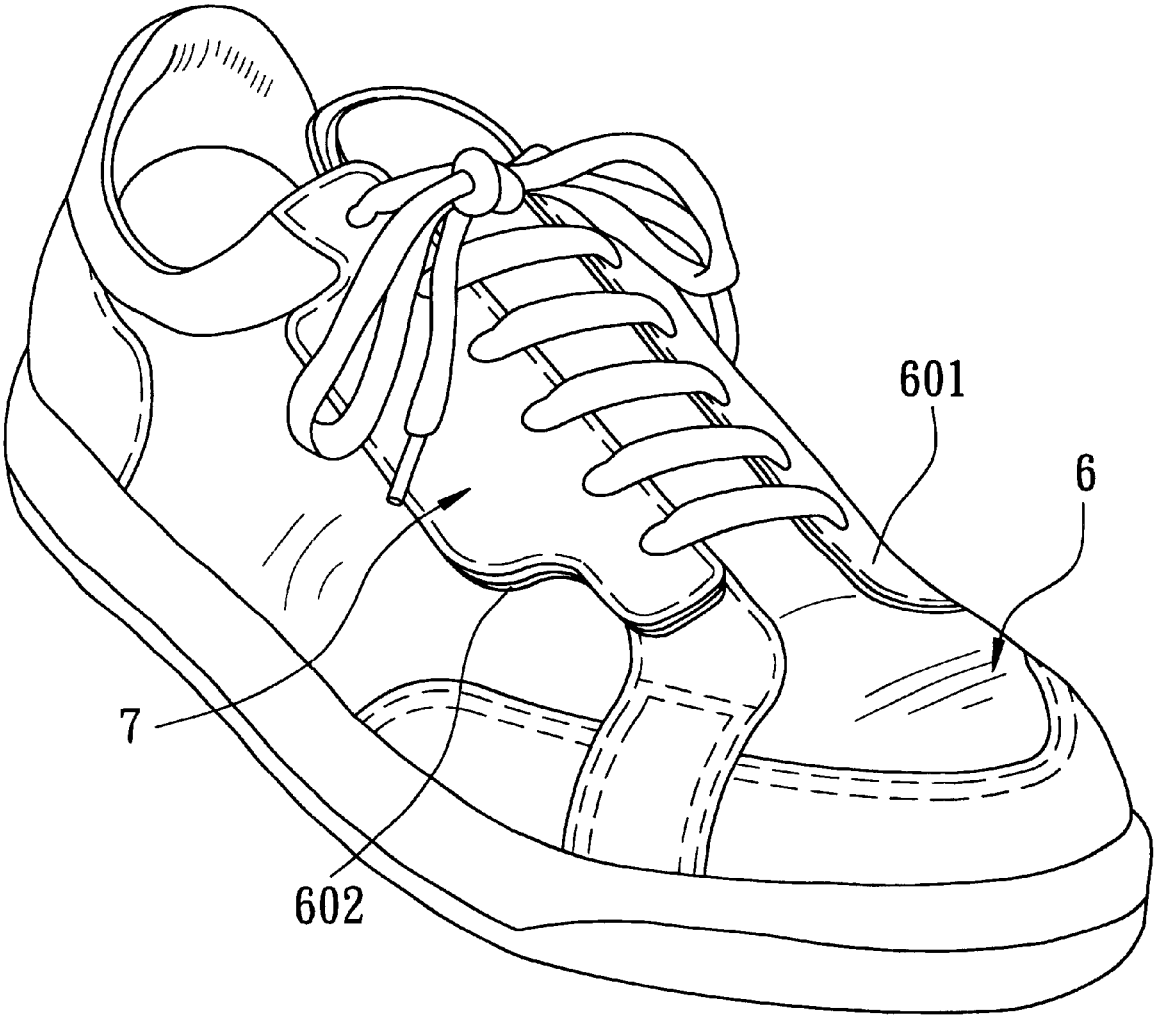
FIG. 4 PRIOR ART
FIG. 4 is a perspective view of the footwear of FIG. 3 in a closed state.
Figure 5:
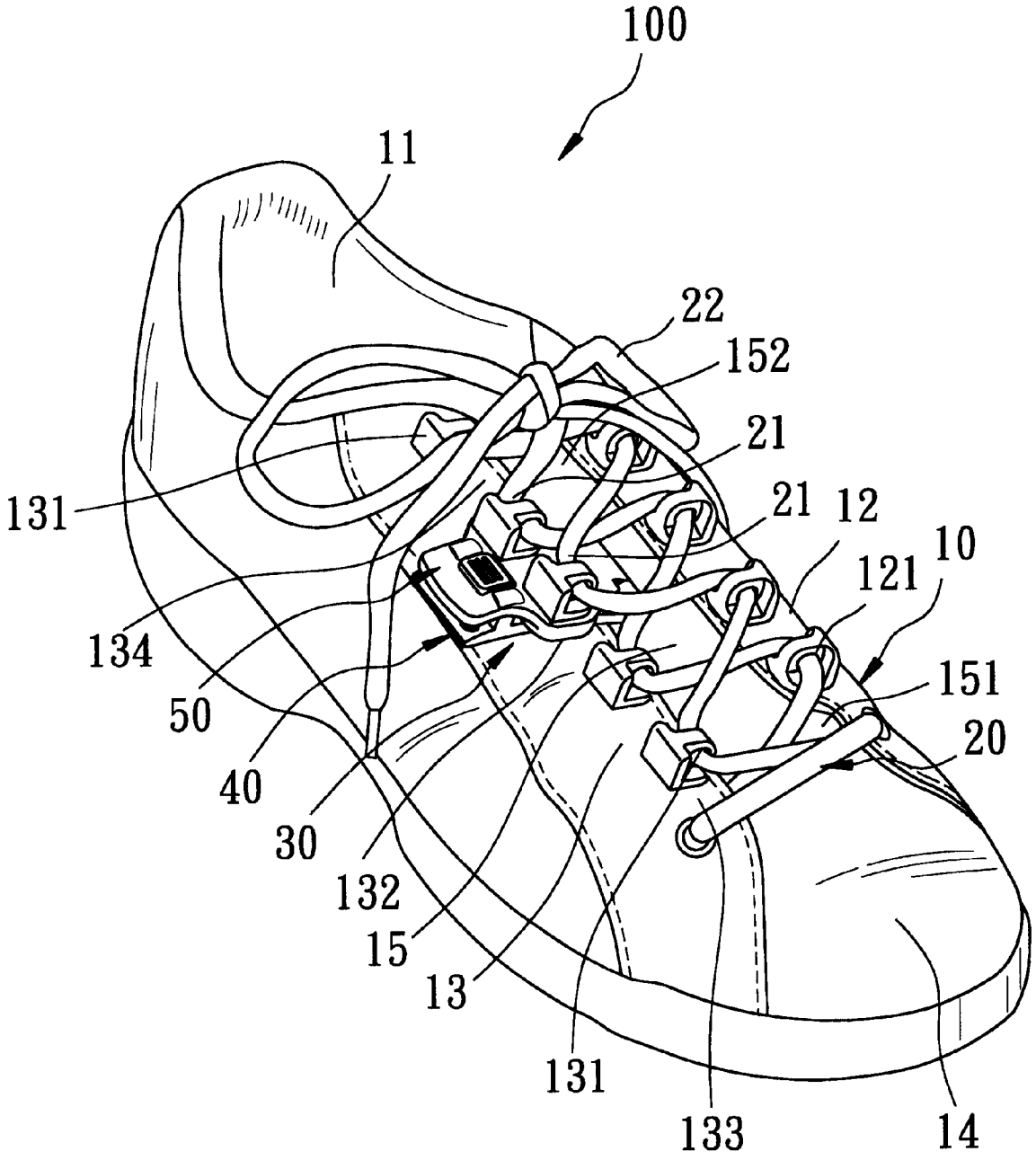
FIG. 5 is a perspective view of the first preferred embodiment of a footwear according to this invention in a closed state.
Figure 6:
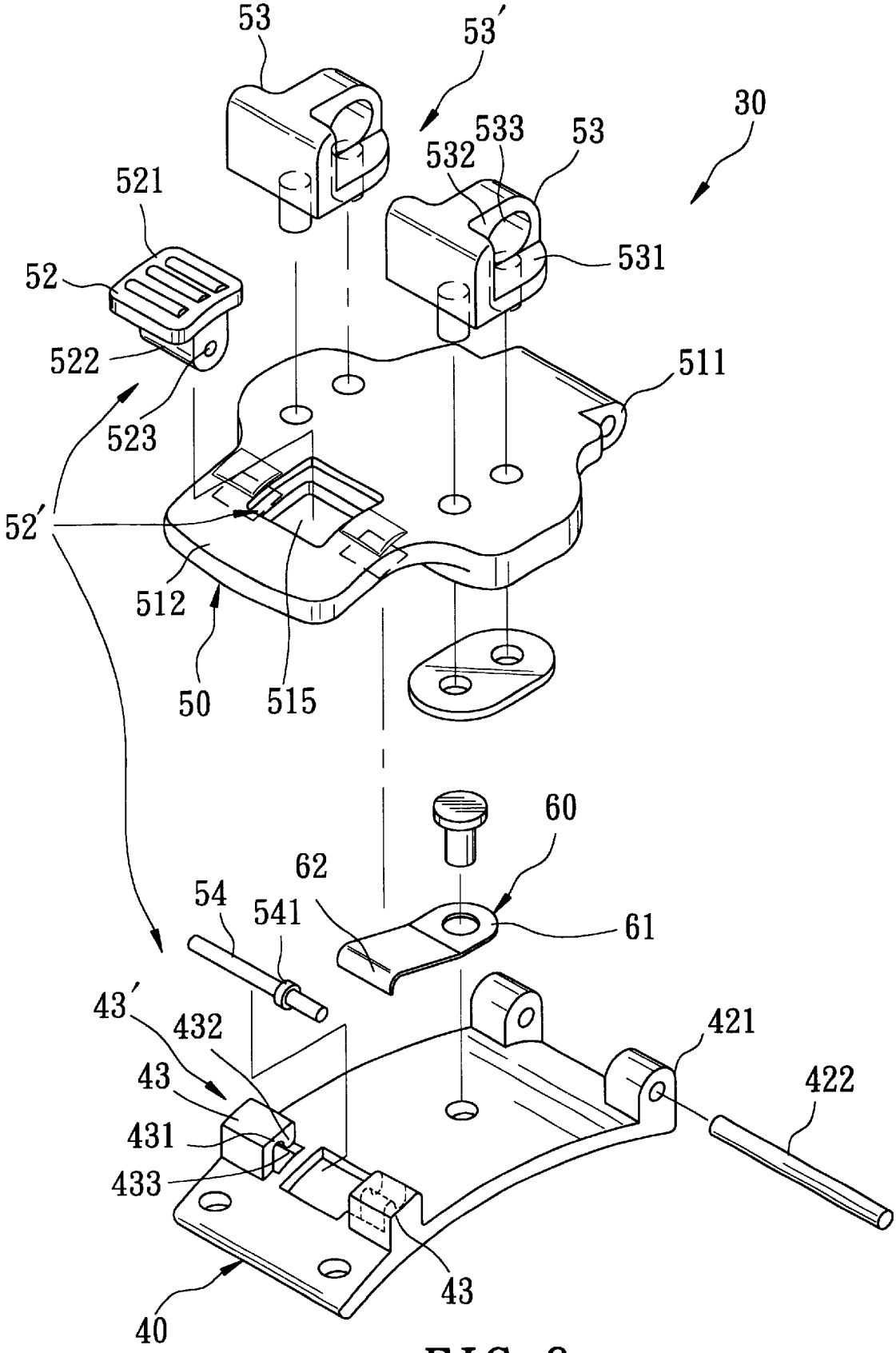
FIG. 6 is an exploded perspective view showing an anchoring assembly of the first preferred embodiment of FIG. 5.
Figure 7:
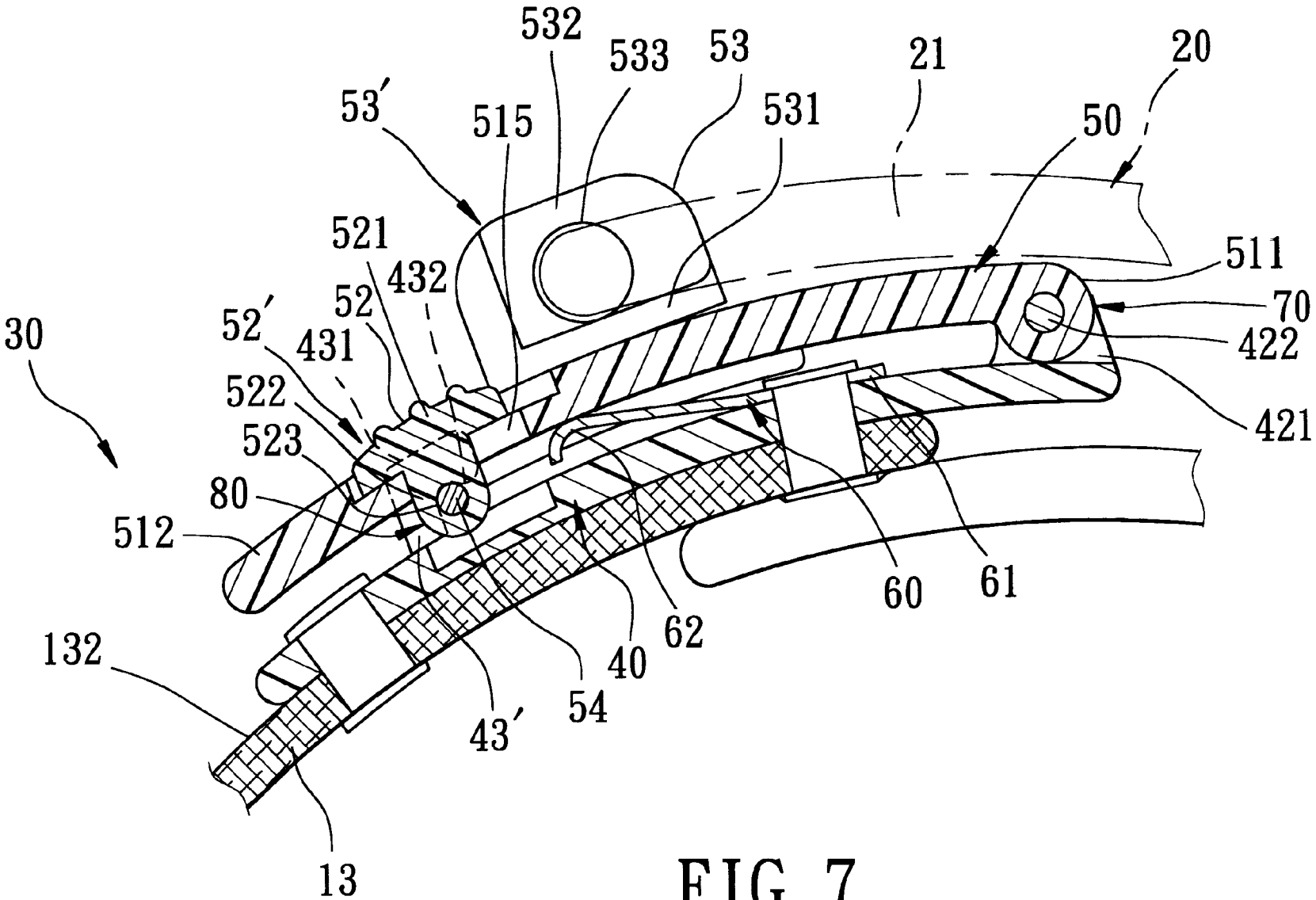
FIG. 7 is a fragmentary sectional view of the first preferred embodiment of FIG. 5, showing the anchoring assembly in a closed state.

Referring to FIGS. 5, 6, 7, the footwear 100 according to this invention is shown to be embodied in a shoe that includes a footwear body 10, an anchoring assembly 30, and a footwear lace unit 20.

The footwear body 10 has a top opening 11, and includes a vamp 14, a tongue 15, a first eyelet tab 12 and a second eyelet tab 13. The tongue 15 has a front portion 151 connected to the vamp 14, and a rear portion 152 extending in a longitudinal direction to the top opening 11. The tongue 15 further has an opposite pair of lateral sides that are spaced apart from each other in a transverse direction transverse to the longitudinal direction and that extend from the vamp 14 to the top opening 11. The first and second eyelet tabs 12, 13 are connected to the vamp 14, and are respectively disposed adjacent to the lateral sides of the tongue 15. The first eyelet tab 12 is formed with a plurality of eyelets 121. The second eyelet tab 13 includes a front portion 133 proximate to the vamp 14, a rear portion 134 proximate to the top opening 11, and an intermediate eyelet-free portion 132 between the front and rear portions 133, 134 of the second eyelet tab 13. The front portion 133 of the second eyelet tab 13 is provided with a plurality of eyelets 131. The rear portion 134 of the second eyelet tab 13 is provided with an eyelet 131.

The anchoring assembly 30 includes a stationary member 40, a pivotable member 50, a pivot unit 70, a releasable fastener unit 80, and a resilient member 60.

The stationary member 40 is a curved rectangular member and is fixed on the eyelet-free portion 132 of the second eyelet tab 13 in a well-known manner, such as riveting.

The pivotable member 50 has a curvature corresponding to that of stationary member 40, and is provided with a footwear lace stringing part 53'. The footwear lace stringing part 53' includes a pair of eyelet units 53 spaced from each other in the longitudinal direction and fixed on the pivotable member 50 in a well-known manner, such as riveting. The space between the pair of eyelet units 53 is equal to that between the corresponding eyelets 121 of the first eyelet tab 12. Each of the eyelet units 53 has a bottom part 531 fixed to the pivotable member 50, and a top part 532 fixed to the bottom part 531 of the eyelet unit 53 and formed with an eyelet 533.

The pivot unit 70 is provided on the stationary and pivotable members 40, 50 proximate to the tongue 15 of the footwear body 10 to permit pivoting movement of the pivotable member 50 relative to the stationary member 40 about a pivot axis that extends in the longitudinal direction between a footwear tightening position, in which the pivotable member 50 is turned toward the stationary member 40 so as to be superimposed on the stationary member 40, and a footwear loosening position, in which the pivotable member 50 is turned away from the stationary member 40. The pivot unit 70 includes: a pair of upright pivot lugs 421 formed on the stationary member 40; a pivot ear 511 formed on the pivotable member 50 and disposed between the pivot lugs 421; and a pivot pin 422 that extends in the longitudinal direction and that couples pivotally the pivot ear 511 to the pivot lugs 421. The pivotable member 50 further includes a grip portion 512 opposite to the pivot ear 511 of the pivot unit 70 in the transverse direction.

The releasable fastener unit 80 is provided on the stationary and pivotable members 40, 50 and releasably retains the pivotable member 50 at the footwear tightening position. The releasable fastener unit 80 includes a hook unit 43' provided on the stationary member 40, and a rod unit 52' provided on the pivotable member 50. The rod unit 52' is movable relative to the hook unit 43' between an engaging position, where the hook and rod units 43', 52' engage each other to retain the pivotable member 50 at the footwear tightening position, and a disengaging position, where the hook and rod units 43', 52' disengage from each other to permit movement of the pivotable member 50 to the footwear loosening position. The rod unit 52' includes a guide hole 515 formed in the grip portion 512 of the pivotable member 50, an operating member 52 movably disposed in the guide hole 515, and an anchor rod 54. The guide hole 515 is a stepped hole, i.e. the upper part of the guide hole 515 has a cross section larger than that of the lower part of the guide hole 515. The operating member 52 includes a finger operating portion 521 and a rod coupling portion 522 extending downwardly from the finger operating portion 521 and through the guide hole 515. A rod coupling hole 523 is formed through the rod coupling part 522. The anchor rod 54 has opposite rod ends, an intermediate rod part coupled to the operating member 52 via extension through the rod coupling hole 523, and a stop ring 541 between the rod end and the intermediate rod part. The anchor rod 54 is disposed below the pivotable member 50. The hook unit 43' includes a pair of hook retainers 43 which extend from the stationary member 40. Each of the hook retainers 43 is formed with a rod receiving slot 433 to receive one of the rod ends of the anchor rod 54 therein. The rod receiving slot 433 is confined by a top retainer wall 431 with a downward limiting flange 432 to restrict outward movement of the respective one of the rod ends of the anchor rod 54 from the receiving slot 433.

The resilient member 60 is disposed between the stationary and pivotable members 40, 50, and provides a biasing force to bias the pivotable member 50 away from the footwear tightening position. The resilient member 60 is made of a resilient material, such as a metal sheet, and includes a biasing end 62 and a fixing end 61 fixed to the stationary member 40 in a well known manner, such as riveting.

The footwear lace unit 20 has a first portion 21 and a second portion 22. The first portion 21 of the footwear lace unit 20 is strung through the eyelets 121 of the first eyelet tab 12, the eyelets 131 of the second eyelet tab 13 and the eyelets 533 of the footwear lace stringing part 53' of the pivotable member 50 to form a criss-cross pattern on the first and second eyelet tabs 12, 13. The second portion 22 of the footwear lace unit 20 is disposed proximate to the top opening 11 and can be tied to form a double-bow configuration.

Figure 8:
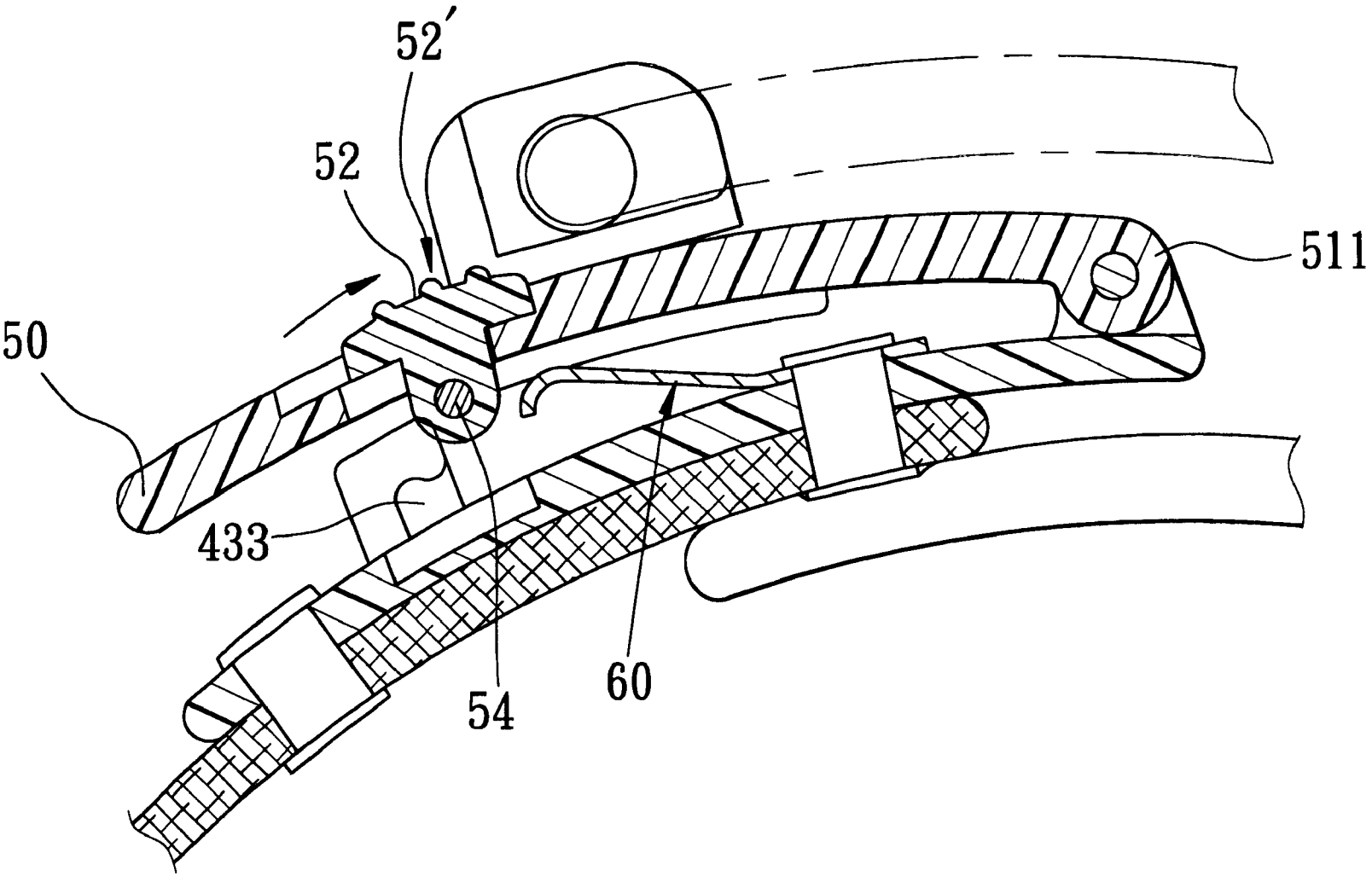
FIG. 8 is a fragmentary sectional view of the first preferred embodiment of FIG. 5, showing how the anchoring assembly is opened.
Figure 9:
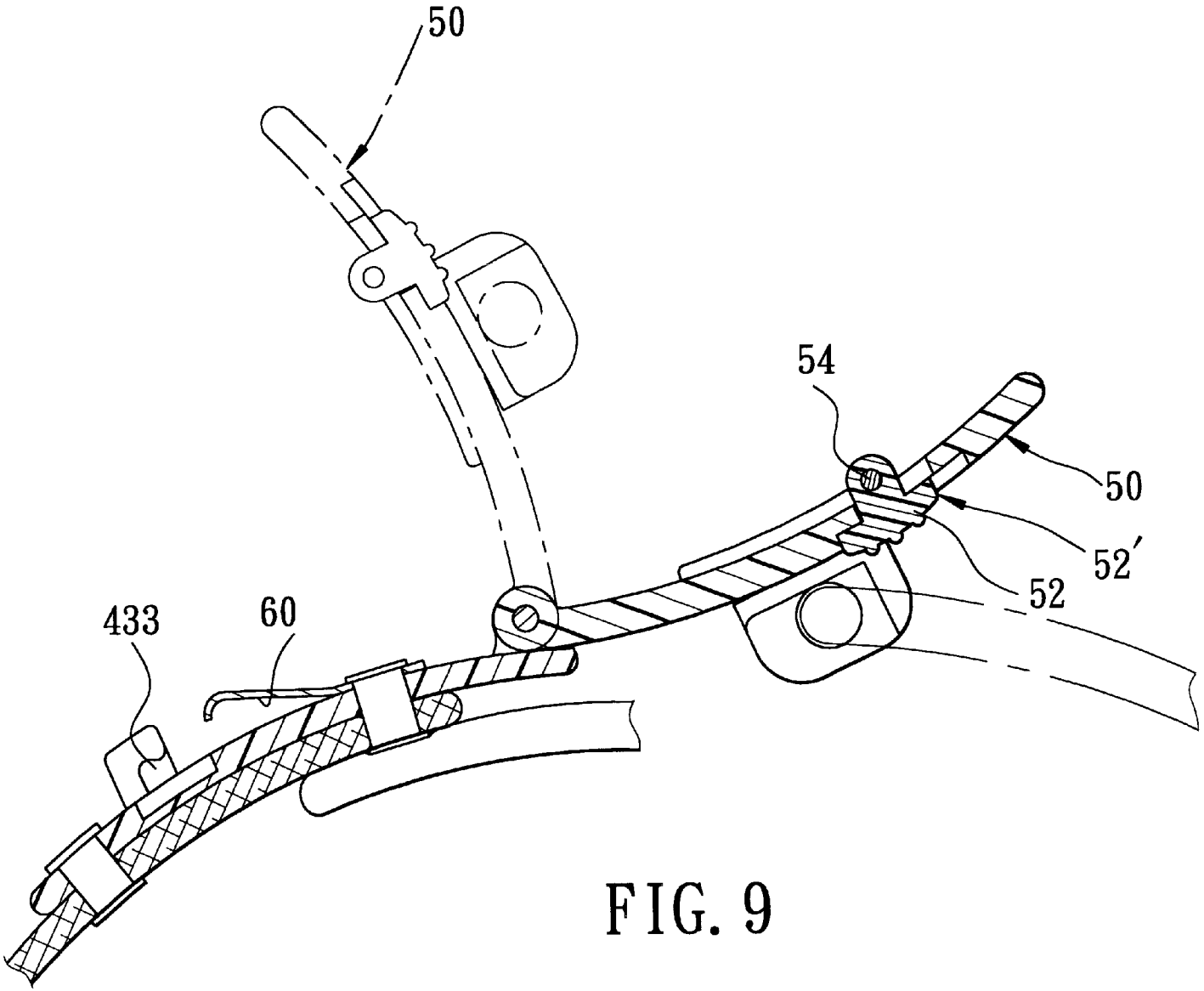
FIG. 9 is a fragmentary sectional view of the first preferred embodiment of FIG. 5, showing the anchoring assembly in a fully-opened state.
Figure 10:
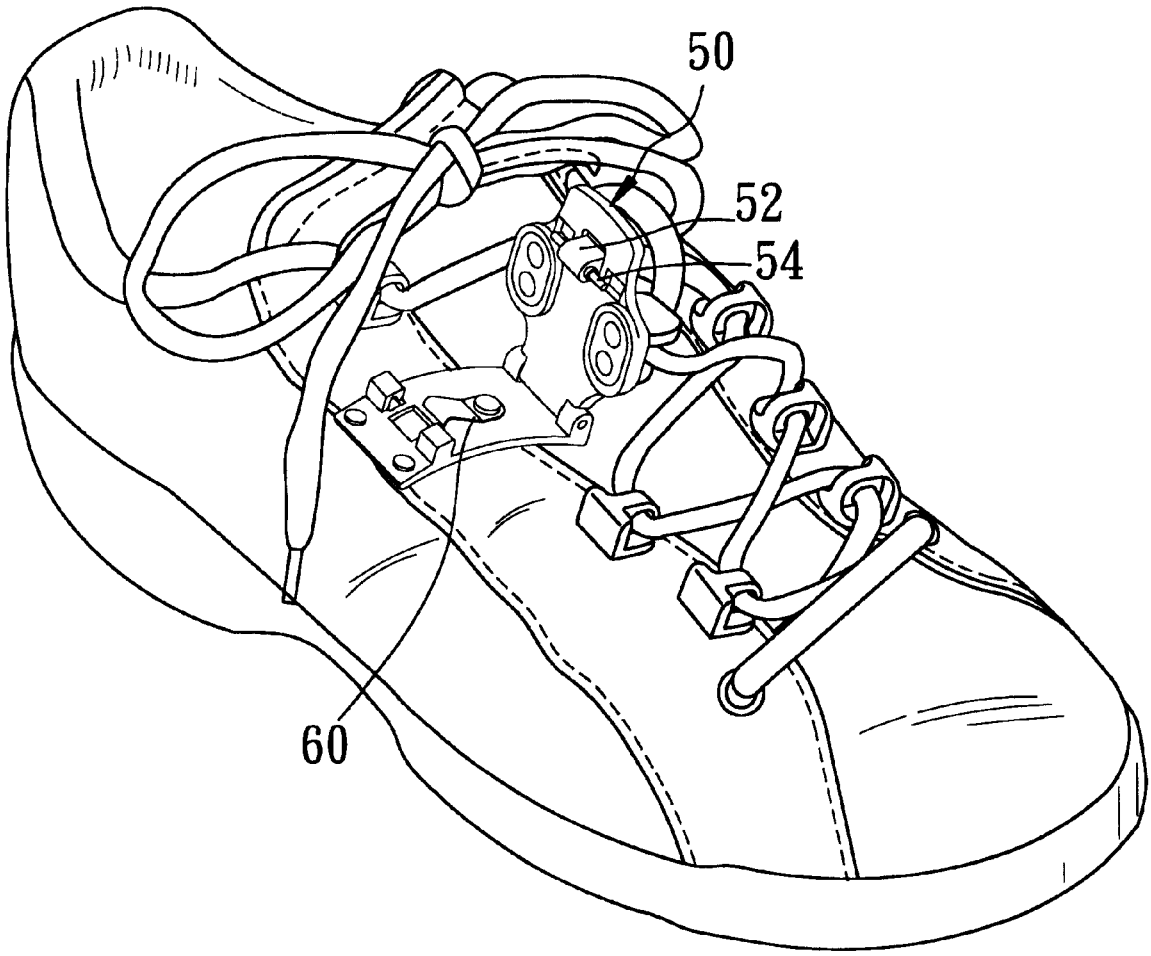
FIG. 10 is a perspective view of the first preferred embodiment of a footwear according to this invention in an opened state.

Referring to FIGS. 8, 9 and 10, when the wearer desires to take off the footwear, the rod unit 52' is moved to the disengaging position by simply moving the operating member 52 in the transverse direction toward the pivot ear 511 so as to disengage the anchor rod 54 from the receiving slots 433 of the hook retainers 43. At this time, the resilient member 60 provides a biasing force to bias the pivotable member 50 away from the footwear tightening position. Therefore, the footwear can be taken off quickly and easily.

Figure 11:
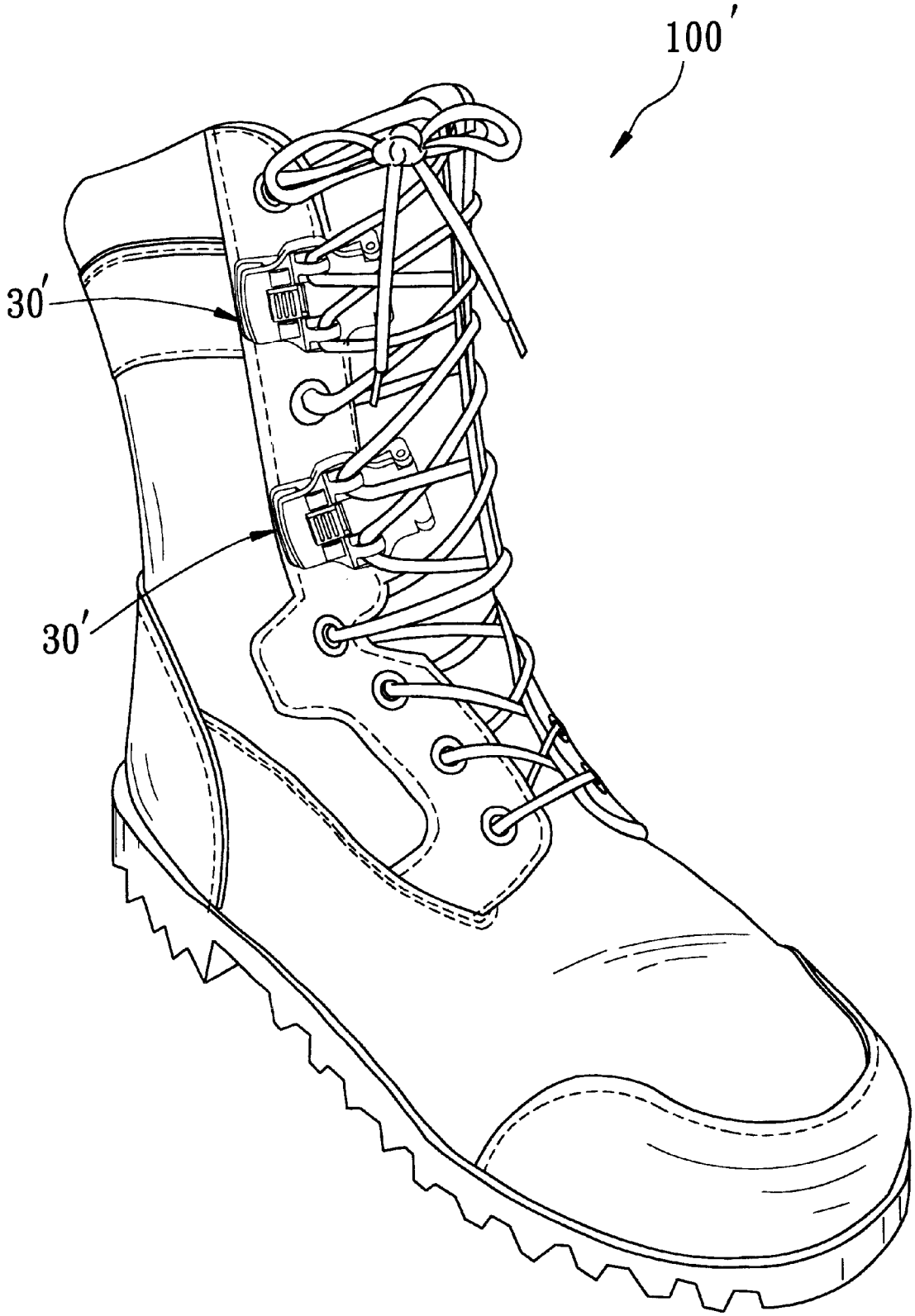
FIG. 11 is a perspective view of another preferred embodiment of a footwear according to this invention.

Referring to FIG. 11, the anchoring assembly 30' of this invention can be applied to another footwear in the form of boot 100'. The configuration, functions and effects of the anchoring assembly 30' used in the boot 100' are similar to those of the anchoring assembly 30 of the aforesaid preferred embodiment, and will not be described further for the sake of brevity.

Figure 12:
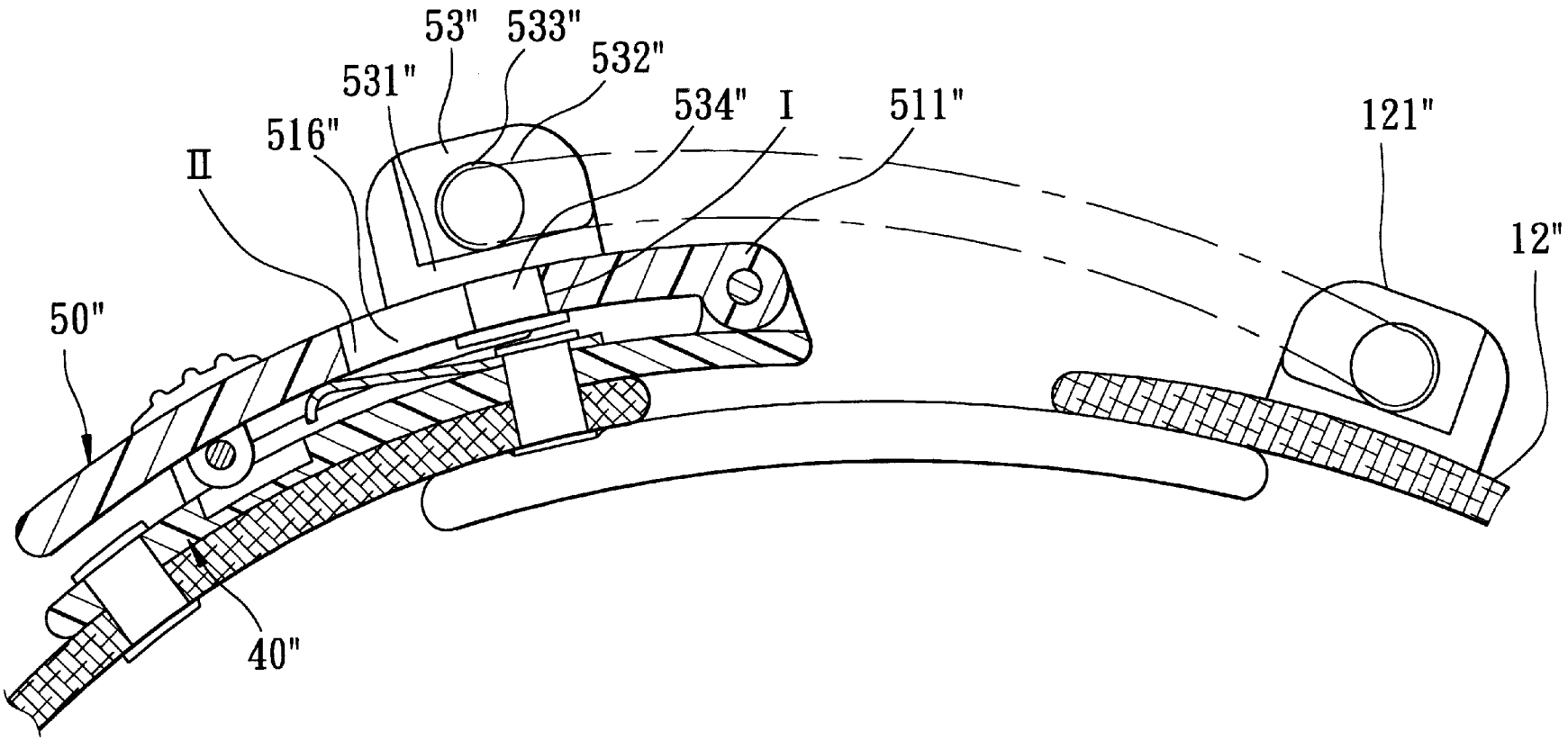
FIG. 12 is a fragmentary sectional view of still another preferred embodiment of a footwear according to this invention in a closed state.
Figure 13:
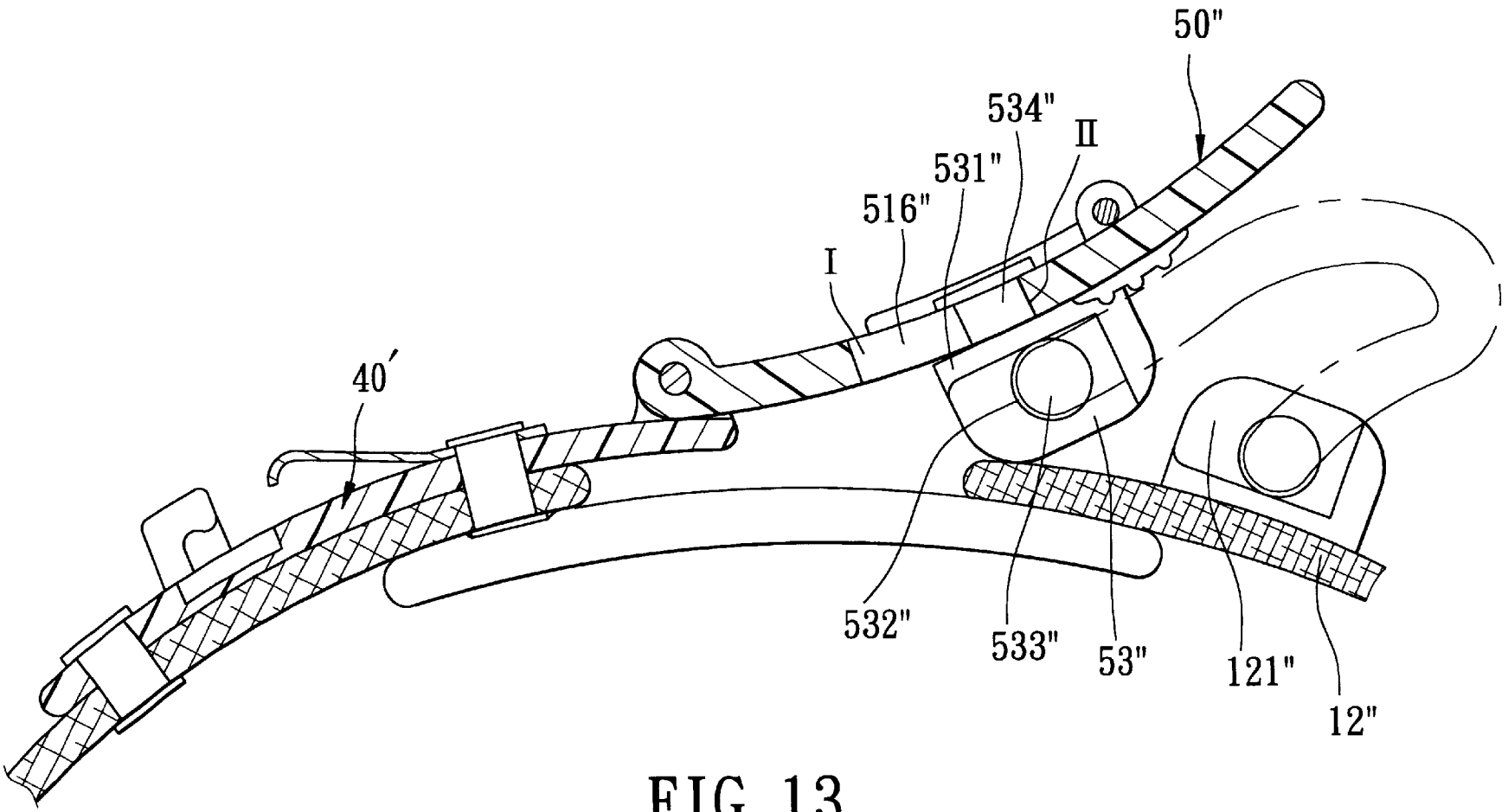
FIG. 13 is a fragmentary sectional view of the preferred embodiment of FIG. 12 in an opened state.

Referring to FIGS. 12 and 13, the pivotable member 50" of yet another embodiment of this invention is formed with a pair of spaced rectangular guiding holes 516" extending in the transverse direction. Each of the guiding holes 516" has a first end (I) proximate to the pivot ear 511" and a second end (II) opposite to the first end (I). A pair of eyelet units 53" are spaced from each other in the longitudinal direction. The space between the pair of eyelet units 53" is equal to that between the corresponding eyelets 121" of the first eyelet tab 12". Each of the eyelet units 53" has a bottom part 531" disposed on top of the pivotable member 50", a top part 532" fixed to the bottom part 531" of the eyelet unit 53" and formed with an eyelet 533", and a guiding pole 534" extending downwardly from the bottom part 531" and through the corresponding guiding hole 516". Each of the eyelet units 53" is movable in the transverse direction between the first end (I) and the second end (II) of the corresponding guiding hole 516" when the pivotable member 50" move pivotally relative to the stationary member 40" between the footwear tightening position shown in FIG. 12 and the footwear loosening position shown in FIG. 13.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A footwear, comprising:

a footwear body having a top opening, said footwear body including a vamp, a tongue, a first eyelet tab and a second eyelet tab, said tongue having a front portion connected to said vamp and a rear portion extending in a longitudinal direction to said top opening, said tongue further having an opposite pair of lateral sides that are spaced apart from each other in a transverse direction transverse to the longitudinal direction and that extend from said vamp to said top opening, said first and second eyelet tabs being connected to said vamp and being respectively disposed adjacent to said lateral sides of said tongue, said first eyelet tab being formed with a plurality of eyelets, said second eyelet tab including a front portion proximate to said vamp, a rear portion proximate to said top opening, and an intermediate eyelet-free portion between said front and rear portions of said second eyelet tab, each of said front and rear portions of said second eyelet tab being provided with at least one eyelet;

an anchoring assembly including a stationary member fixed on said eyelet-free portion of said second eyelet tab, a pivotable member provided with a footwear lace stringing part that is formed with at least one eyelet, a pivot unit provided on said stationary and pivotable members proximate to said tongue of said footwear body to permit pivoting movement of said pivotable member relative to said stationary member about a pivot axis that extends in the longitudinal direction between a footwear tightening position, in which said pivotable member is turned toward said stationary member so as to be superimposed on said stationary member, and a footwear loosening position, in which said pivotable member is turned away from said stationary member, and a releasable fastener unit, provided on said stationary and pivotable members, for releasably retaining said pivotable member at said footwear tightening position; and a footwear lace unit having a first portion and a second portion, said first portion of said footwear lace unit being strung through said eyelets of said first eyelet tab, said eyelets of said second eyelet tab and said at least one eyelet of said footwear lace stringing part of said pivotable member to form a criss-cross pattern on said first and second eyelet tabs, said second portion of said footwear lace unit being disposed proximate to said top opening.

2. The footwear as claimed in claim 1, wherein said pivot unit includes:

a pair of upright pivot lugs formed on said stationary member;

a pivot ear formed on said pivotable member and disposed between said pivot lugs; and a pivot pin that extends in the longitudinal direction and that couples pivotally said pivot ear to said pivot lugs.

3. The footwear as claimed in claim 1, wherein said releasable fastener unit includes:

a hook unit provided on one of said stationary and pivotable members; and a rod unit provided on the other one of said stationary and pivotable members;

one of said hook and rod units being movable relative to the other of said hook and rod units between an engaging position, where said hook and rod units engage each other to retain said pivotable member at said footwear tightening position, and a disengaging position, where said hook and rod units disengage from each other to permit movement of said pivotable member to said footwear loosening position.

4. The footwear as claimed in claim 3, wherein said rod unit includes:

a guide hole formed in said pivotable member;

an operating member movably disposed in said guide hole; and an anchor rod having opposite rod ends, and an intermediate rod part coupled to said operating member, said anchor rod being disposed below said pivotable member.

5. The footwear as claimed in claim 4, wherein said hook unit includes a pair of hook retainers which extend from said stationary member, each of said hook retainers being formed with a rod receiving slot to receive one of said rod ends of said anchor rod therein, said rod receiving slot being confined by a top retainer wall with a downward limiting flange to restrict outward movement of the respective one of said rod ends from said receiving slot.

6. The footwear as claimed in claim 3, wherein said anchoring assembly further includes a resilient member which is disposed between said stationary and pivotable members and which provides a biasing force to bias said pivotable member away from said footwear tightening position.

7. The footwear as claimed in claim 1, wherein said anchoring assembly further includes a resilient member which is disposed between said stationary and pivotable members and which provides a biasing force to bias said pivotable member away from said footwear tightening position.

8. The footwear as claimed in claim 1, wherein said footwear lace stringing part includes a pair of eyelet units spaced from each other in the longitudinal direction and fixed on said pivotable member.

9. The footwear as claimed in claim 1, wherein said pivotable member includes a rectangular guiding hole extending in the transverse direction, said footwear lace stringing part including an eyelet unit having a guiding pole extending through said guiding hole to permit movement of said footwear lace stringing part in the transverse direction when said pivotable member is turned relative to said stationary member.

* * * * *

UNITED STATES PATENT AND TRADEMARK OFFICE

CERTIFICATE OF CORRECTION

PATENT NO. : 6,640,466 B1
DATED : November 4, 2003
INVENTOR(S) : Liu

It is certified that error appears in the above-identified patent and that said Letters Patent is hereby corrected as shown below:

Title page,
Item [56], References Cited, U.S. PATENT DOCUMENTS, after "Louviere" delete "24/12.1" and insert -- 24/712.1 --.

Signed and Sealed this

Fourth Day of April, 2006

JON W. DUDAS
*Director of the United States Patent and Trademark Office*